US010807256B2

(12) United States Patent
Nordstrom

(10) Patent No.: US 10,807,256 B2
(45) Date of Patent: Oct. 20, 2020

(54) MODULAR SAFETY RAZOR WITH ADJUSTABLE BLADE ANGLE

(71) Applicant: ROCKWELL RAZORS CORPORATION, Toronto (CA)

(72) Inventor: Morgan Nordstrom, Ottawa (CA)

(73) Assignee: ROCKWELL RAZORS CORPORATION, Toronto (CA)

( * ) Notice: Subject to any disclaimer, the term of this patent is extended or adjusted under 35 U.S.C. 154(b) by 0 days.

(21) Appl. No.: 15/510,294

(22) PCT Filed: Sep. 11, 2015

(86) PCT No.: PCT/CA2015/000491

§ 371 (c)(1),
(2) Date: Mar. 10, 2017

(87) PCT Pub. No.: WO2016/037265

PCT Pub. Date: Mar. 17, 2016

(65) Prior Publication Data

US 2017/0297212 A1 Oct. 19, 2017

Related U.S. Application Data

(63) Continuation-in-part of application No. 14/484,330, filed on Sep. 12, 2014, now Pat. No. 9,505,142.

(51) Int. Cl.
*B26B 21/18* (2006.01)
*B26B 21/52* (2006.01)

(52) U.S. Cl.
CPC ..... *B26B 21/185* (2013.01); *B26B 21/18* (2013.01); *B26B 21/521* (2013.01)

(58) Field of Classification Search
CPC ..... B26B 21/185; B26B 21/531
(Continued)

(56) References Cited

U.S. PATENT DOCUMENTS 1,071,970 A 9/1913 Stutzman ..... B27G 13/04 144/225
1,272,816 A * 7/1918 Leslie ..... B24B 21/14 30/346.61

(Continued)

FOREIGN PATENT DOCUMENTS

CA 799671 A 11/1968
CN 2710852 Y 7/2005

(Continued)

OTHER PUBLICATIONS

United States Patent and Trademark Office, Office Action issued in U.S. Appl. No. 29/539,215 dated Sep. 26, 2016.

(Continued)

*Primary Examiner* — Ghassem Alie
*Assistant Examiner* — Bharat C Patel
(74) *Attorney, Agent, or Firm* — Norton Rose Fulbright Canada LLP

(57) ABSTRACT

A safety razor for personal grooming having a handle, a cap, an attachment mechanism, a double sided base plate, and a double edged safety razor blade. The double sided base plate comprising a central aperture for enabling the engagement between the handle and the cap; a first side having a first angled blade-engaging surface opposite a second angled blade-engaging surface, the first and second blade engaging surfaces defining a respective first and second blade gap when the razor blade is secured between the cap and the first side of the double sided base plate; and a second side having a third angled blade-engaging surface opposite a fourth angled blade-engaging surface, the third and fourth blade engaging surfaces defining a respective third and fourth blade gap when the razor blade is secured between the cap and the second side of the double sided base plate.

29 Claims, 8 Drawing Sheets

(58) Field of Classification Search
USPC ..... 30/32, 532, 534, 71
See application file for complete search history.

(56) References Cited

U.S. PATENT DOCUMENTS

| | | | | | |
|---|---|---|---|---|---|
| 1,496,295 | A | | 6/1924 | Chance | B26B 21/18 30/71 |
| 1,765,805 | A | | 6/1930 | Schlussler | B26B 21/18 30/41 |
| 1,815,745 | A | | 7/1931 | Thompson | |
| 1,923,439 | A | * | 8/1933 | Hukill | B26B 21/22 30/50 |
| 2,128,772 | A | | 8/1938 | Green | |
| 2,141,339 | A | | 12/1938 | Bauerle | B26B 21/18 30/346.61 |
| 2,144,041 | A | * | 1/1939 | Arey | B26B 21/18 30/346.61 |
| 2,270,388 | A | | 1/1942 | Stampleman | B26B 21/18 30/72 |
| 2,321,350 | A | | 6/1943 | Ardner | |
| 2,333,894 | A | | 11/1943 | Smith | B26B 21/18 30/41 |
| 2,342,161 | A | | 2/1944 | Muros | B26B 21/18 30/64 |
| 2,472,807 | A | | 6/1949 | Clark | B26B 21/18 30/70 |
| 2,505,493 | A | * | 4/1950 | Herrmann | B26B 21/22 30/50 |
| 2,555,105 | A | * | 5/1951 | Ayotte | B26B 21/16 30/531 |
| 2,558,601 | A | * | 6/1951 | Winslow | B26B 21/18 30/32 |
| 2,567,811 | A | | 9/1951 | Haushalter | B26B 21/185 30/534 |
| 2,573,980 | A | | 11/1951 | Mitchell | |
| 2,637,101 | A | | 5/1953 | Culler | |
| 2,637,905 | A | | 5/1953 | Williams | B26B 21/18 30/346.55 |
| 2,669,777 | A | * | 2/1954 | Scully | B26B 21/18 30/72 |
| 2,671,265 | A | | 3/1954 | Gavrilla et al. | |
| 2,705,834 | A | | 4/1955 | Lundy | B26B 21/56 30/32 |
| D175,896 | S | | 10/1955 | Macmicking | |
| 2,741,840 | A | * | 4/1956 | Brophy | B26B 21/185 30/73 |
| 2,794,246 | A | | 6/1957 | Marsh et al. | |
| 3,015,158 | A | * | 1/1962 | Ayotte | B26B 21/16 30/41 |
| 3,079,685 | A | * | 3/1963 | Scully | B26B 21/185 30/346.61 |
| 3,088,206 | A | * | 5/1963 | Muros | B26B 21/185 30/60.5 |
| 3,129,508 | A | | 4/1964 | Dootson | |
| 3,413,720 | A | | 12/1968 | Mullen | |
| 3,583,262 | A | | 6/1971 | Mullen | |
| 3,626,591 | A | | 12/1971 | Robey | |
| 3,680,211 | A | | 8/1972 | Keck | 30/41.5 |
| 3,748,735 | A | | 7/1973 | Whittington | B26B 21/18 30/534 |
| 3,777,396 | A | | 12/1973 | Simonetti | |
| 3,889,370 | A | | 6/1975 | Hale, III | |
| 4,066,111 | A | | 1/1978 | Klebe, Jr. | B27G 13/04 144/225 |
| 4,339,876 | A | * | 7/1982 | Davis | B26B 21/222 132/289 |
| 4,749,014 | A | | 6/1988 | Schlund | B27G 13/04 144/117.4 |
| 5,363,892 | A | | 11/1994 | Hild | B27G 13/04 144/117.4 |
| 6,581,290 | B1 | * | 6/2003 | Fishel | B26B 21/222 132/289 |
| 6,808,074 | B1 | * | 10/2004 | Schwartz | A47F 3/005 206/577 |
| 7,100,649 | B2 | | 9/2006 | Liu | B27G 13/04 144/117.1 |
| 8,726,520 | B1 | * | 5/2014 | Abraham | B26B 21/4081 30/32 |
| D763,506 | S | | 8/2016 | Barrett | |
| 2009/0007443 | A1 | | 1/2009 | Cuocolo, Jr. | |
| 2011/0197446 | A1 | | 8/2011 | Macove | |
| 2015/0298327 | A1 | | 10/2015 | Tomassetti et al. | |
| 2015/0352737 | A1 | | 12/2015 | Hickam | |
| 2016/0075040 | A1 | | 3/2016 | Nordstrom | |

FOREIGN PATENT DOCUMENTS

| | | | |
|---|---|---|---|
| CN | 101554733 | A | 10/2009 |
| DE | 2544425 | A1 | 4/1976 |
| DE | 202013005918 | U1 | 9/2013 |
| FR | 737509 | A | 12/1932 |
| FR | 779648 | A | 4/1935 |
| FR | 807430 | | 1/1937 |
| GB | 15552 | A | 1/1911 |
| GB | 193704 | A | 3/1923 |
| GB | 422197 | A | 1/1935 |
| GB | 504986 | | 5/1939 |
| GB | 714122 | | 8/1954 |
| SU | 1321360 | A3 | 6/1987 |

OTHER PUBLICATIONS

International Searching Authority, International Search Report and Written Opinion dated Nov. 27, 2015 in International Patent Application No. PCT/CA2015/000491.

shaveinfo.com, "About Razor Blade Angles FAQ's", http://shaveinfo.com/shaving-information/blade-angle.htm, May 2015.

Maggard Razors Maggard Razors MR1 Knurled Stainless Steel Handle Safety Razor, http://www.maggardrazors.com/product/maggard-razors-mr1-chrome-safety-razor/, last accessed Jan. 5, 2016.

Muehle Shaving Cultutre, Product Section—Safety Razors, http://www.muehle-shaving.com/en/Product-world/Razors/, last accessed Jan. 5, 2016.

Supplementary European Search Report issued in European Application No. 15839288, dated Apr. 10, 2018.

Examination Report #2 issued in Australian Application No. 2015316125, dated Jun. 22, 2018.

Notice of Preliminary Rejection issued in Korean Application No. 10-2017-7009674, dated Jul. 17, 2018.

Chinese Office Action issued in Chinese Application No. 201580061249.6, dated Jun. 26, 2018.

Russian Office Action and Search Report issued in Russian Application No. 2017112318, dated Apr. 12, 2019.

* cited by examiner

MODULAR SAFETY RAZOR WITH ADJUSTABLE BLADE ANGLE

CROSS-REFERENCE TO RELATED APPLICATIONS

This application is a national phase application under 35 U.S.C. 371 of International Patent Application No. PCT/CA2015/000491 filed on Sep. 11, 2015, which is a continuation-in-part and claims all benefit, including priority, of U.S. patent application Ser. No. 14/484,330, filed Sep. 12, 2014, and entitled "Modular Safety Razor with Adjustable Blade Angle," the entire contents of which are herein incorporated by this reference.

FIELD

The present disclosure relates generally to a safety razors used for personal grooming. More particularly, the disclosure relates to adjustment mechanisms for selecting the aggressiveness of the shave provided by the safety razor.

BACKGROUND

A safety razor is a shaving implement with a protective device positioned between the edge of the blade and the skin. The initial purpose of these protective devices was to reduce the level of skill needed for injury-free shaving, thereby reducing the reliance on professional barbers for providing that service and raising grooming standards.

The term safety razor was first used in U.S. Pat. No. 228,904 issued to Frederic and Otto Kampfe in 1880, for a razor in the basic contemporary configuration with a handle attached at right angles to a head in which a removable blade is placed.

Not much has changed in the innovation of the design of safety razors since King C. Gillette's U.S. Pat. No. 775,134 was issued in 1904. Gillette's innovation was a thin, cheap, double-edged blade that could be disposed of when dull. Gillette's blade holder clamped the blade between a backing and a guard plate that was then attached to a handle. The patented design also allowed for adjusting the gap between the blade and the guard plate to allow for light or heavy growth beards or to suit the skill or custom of the shaver.

The most popular modern shaving implement uses cartridge based razors that include a number of single-edged razors in a disposable cartridges. The consumer cost of these disposable cartridges is quite high and has been an impetus for the return to traditional wet shaving using double-edged safety razors. Refilling a traditional safety razor can cost under 10 cents whereas modern cartridges can cost well over $2 to replace. Today's modern razor cartridges can also irritate the skin more than needed due to the multiple blades.

The term "aggressiveness" is used with respect to traditional, non-cartridge based razors to refer to the subjective feeling and performance of the safety razor. Generally, more aggressive safety razors expose more of the razor blade to the skin and are suitable for a heavier beard as they will require less strokes. These more aggressive safety razors are also prone to more nicks, cuts and irritation, and require a more skilled hand. Less aggressive safety razors can be suitable for shorter stubble and beginners to safety razor shaving. Because a person's stubble can vary in length depending on the time from his or her last shave, it is desirable to have a safety razor that can provide different levels of aggressiveness.

The aggressiveness of a safety razor can be defined by a number of different factors, including, but not limited to, the exposure of the blade and the blade gap. The exposure of the blade is defined as the protrusion of the blade edge beyond a line tangent to the cap and the guard, and the blade gap is defined as the space between the blade edge and the guard. Other factors that can influence aggressiveness can include the weight of the razor head, overall razor weight balance between the handle and razor head, and the handle length.

Safety razor designs have often tried to provide some level of to adjust aggressiveness of the razor. Often, as in King C. Gillette's above patent, this is provided by some means to adjust the blade gap between the blade and the guard plate. Other examples of this type of adjustments include U.S. Pat. No. 284,880 to Schnitzler et al. and U.S. Pat. No. 2,700,817 to Erickson. Adjustment of the blade gap can allow for variance in stubble length but is only one factor affecting aggressiveness of a safety razor. Unintentionally changing the blade gap can change subjective aggressiveness of the safety razor significantly.

Blade angle is another factor that influences aggressiveness of a safety razor. The blade angle can be defined as the angle between the blade edge and a line tangent to the cap and guard. There is a preferable angle of about 30 degrees from the face, but this may vary based on the different beards, stubble length, skin type (i.e. likeliness of razor irritation), and even different areas of the same beard (e.g. neck versus face). Traditional double-edged safety razor designs typically have a fixed geometry for clamping the blade between the cap and guard plate that provides for a single static blade angle. Some single-edge razor designs have provided mechanical adjustment mechanisms that can be prone to failure or slippage, or that not translate to double-edged safety razors, such as that shown in U.S. Pat. No. 3,080,651 to La Cas.

SUMMARY

According to a first aspect, there is provided a safety razor comprising: a handle; a cap; an attachment mechanism to engage the handle and the cap; and a double sided base plate defining a central aperture for enabling the engagement between the handle and the cap, the double sided base plate comprising: a first side having a first angled blade-engaging surface opposite a second angled blade-engaging surface, the first and second blade engaging surfaces defining a respective first and second blade gap when a double edged safety razor blade is secured between the cap and the first side of the double sided base plate; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate.

According to a second aspect, there is provided a double sided base plate for use with a safety razor, the base plate comprising: a first side having a first angled blade-engaging surface opposite a second angled blade-engaging surface, the first and second blade engaging surfaces defining a respective first and second blade gap when a double edged safety razor blade is secured between the cap and the first side of the double sided base plate; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate.

According to yet another aspect, there is provided a modular safety razor shaving kit, the kit comprising: a handle a cap; an attachment mechanism to engage the handle and the cap; and a plurality of double sided base plates, each of the plurality of double sided base plates defining a central aperture for enabling the engagement between the handle and the cap, each of the plurality of double sided base plates comprising: a first side having a first angled blade-engaging surface opposite a second angled blade-engaging surface, the first and second blade engaging surfaces defining a respective first and second blade gap when a double edged safety razor blade is secured between the cap and the first side of the double sided base plate, the first and second blade gaps defining a first blade gap set; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate, the third and fourth blade gaps defining a second blade gap set.

BRIEF DESCRIPTION OF THE DRAWINGS

For a better understanding of the various embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

It will be appreciated that for simplicity and clarity of illustration, where considered appropriate, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementations of various embodiments described herein.

Although some embodiments may explicitly refer to the double-edged safety razor shaving implements, it will be understood by those of ordinary skill in the art that teachings described herein can be applied to other shaving implements that have a similar cap and base plate structure. For example, and without limitation, devices that use a single edged blade can also be used to implement the embodiments described herein.

The term safety razor is used herein to refer to shaving implements for retaining a single user replaceable blade, and does not include cartridge-based razors or other disposable razors using multiple single edged blades.

Figure 1:
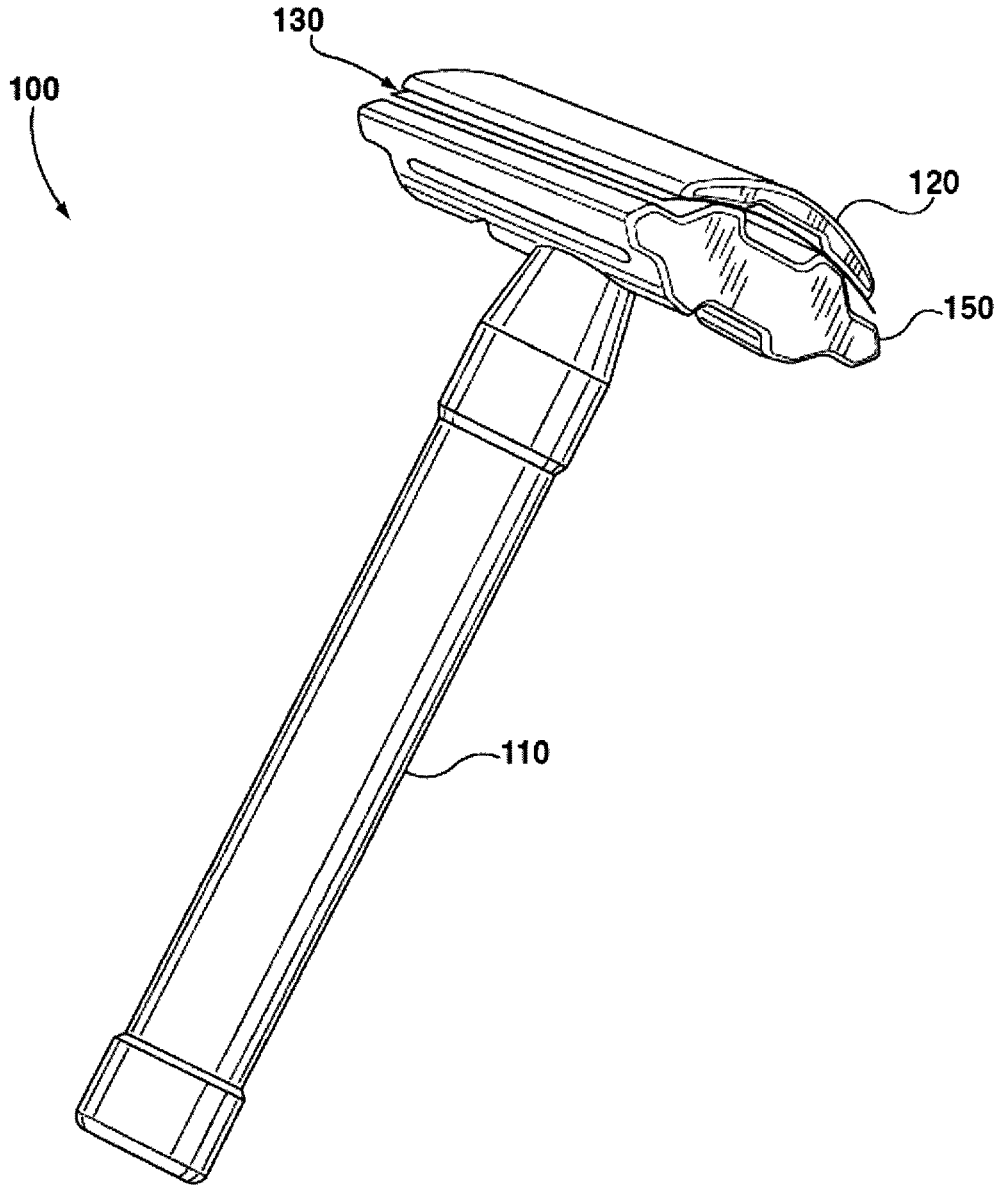
FIG. 1 is a perspective view of an embodiment of a safety razor having a handle, base plate and cap.
Figure 1A:
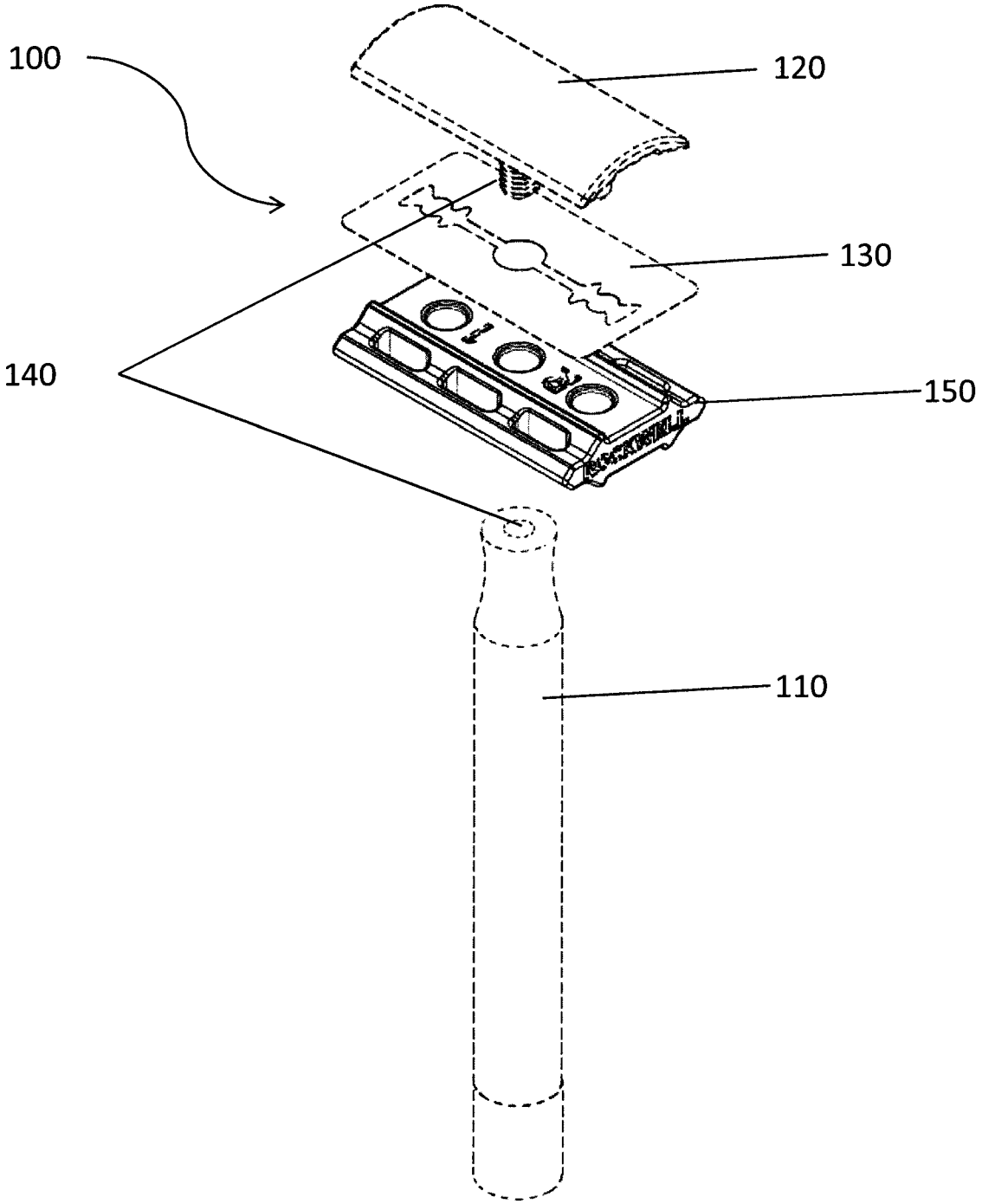
FIG. 1A is a perspective view of an embodiment of a safety razor having a handle, base plate and cap, in an extended view.
Figure 2:
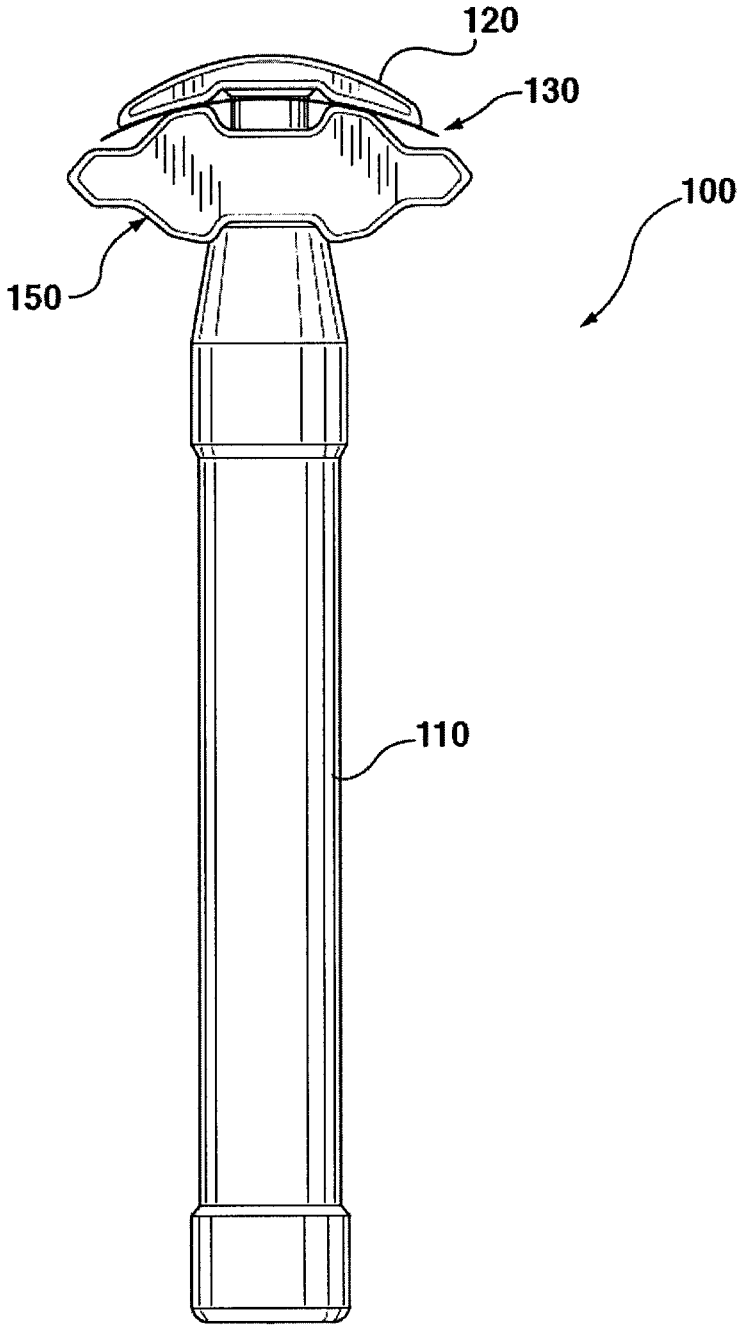
FIG. 2 is a side view of the safety razor shown in FIG. 1.

Referring first to FIGS. 1, 1A and 2, shown are perspective view and side views of an embodiment of a safety razor 100 comprising a handle 110, a cap 120, and a double sided base plate 150. Safety razor 100 is configured to hold a razor blade 130 clamped between cap 120 and base plate 150. In some embodiments, razor blade 130 is the commonly used double-edged razor blade and cap 120 is symmetrical on either side of handle 110. Other embodiments can employ a singled-edged razor blade so long as cap 120 and base plate 150 are modified to secure or clamp blade 130.

Safety razor 100 further comprises an attachment mechanism 140 for engaging the handle 110 and the cap 120. In some embodiments, for example, the attachment mechanism comprises a central threaded stud disposed on the cap 120 to threadingly engage the handle 110. In yet other embodiments, for example, the attachment mechanism comprises a central threaded stud disposed on the handle 110 to threadingly engage the cap 120. In other embodiments, for example, the attachment mechanism may comprise another means of attaching the handle 110 to the cap 120 known to those skilled in the art, for example, the attachment mechanism may comprise fitting together the handle 110 and cap by friction fit or adhesives.

Figure 3A:
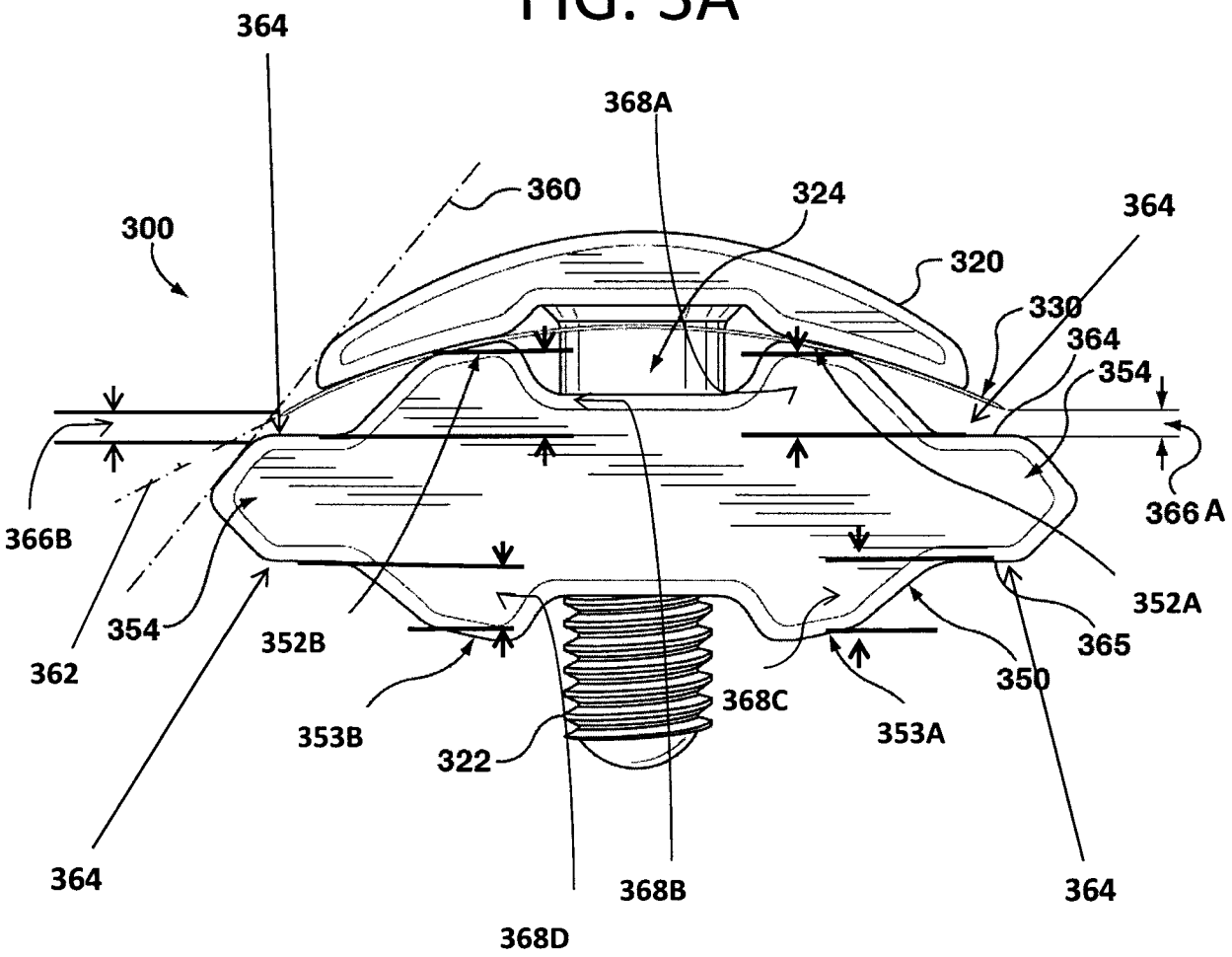
FIG. 3A is a side view of a cap and a double sided base plate embodiment of a safety razor securing a double-edged safety razor between the cap and the first side of the double sided base plate.
Figure 3B:
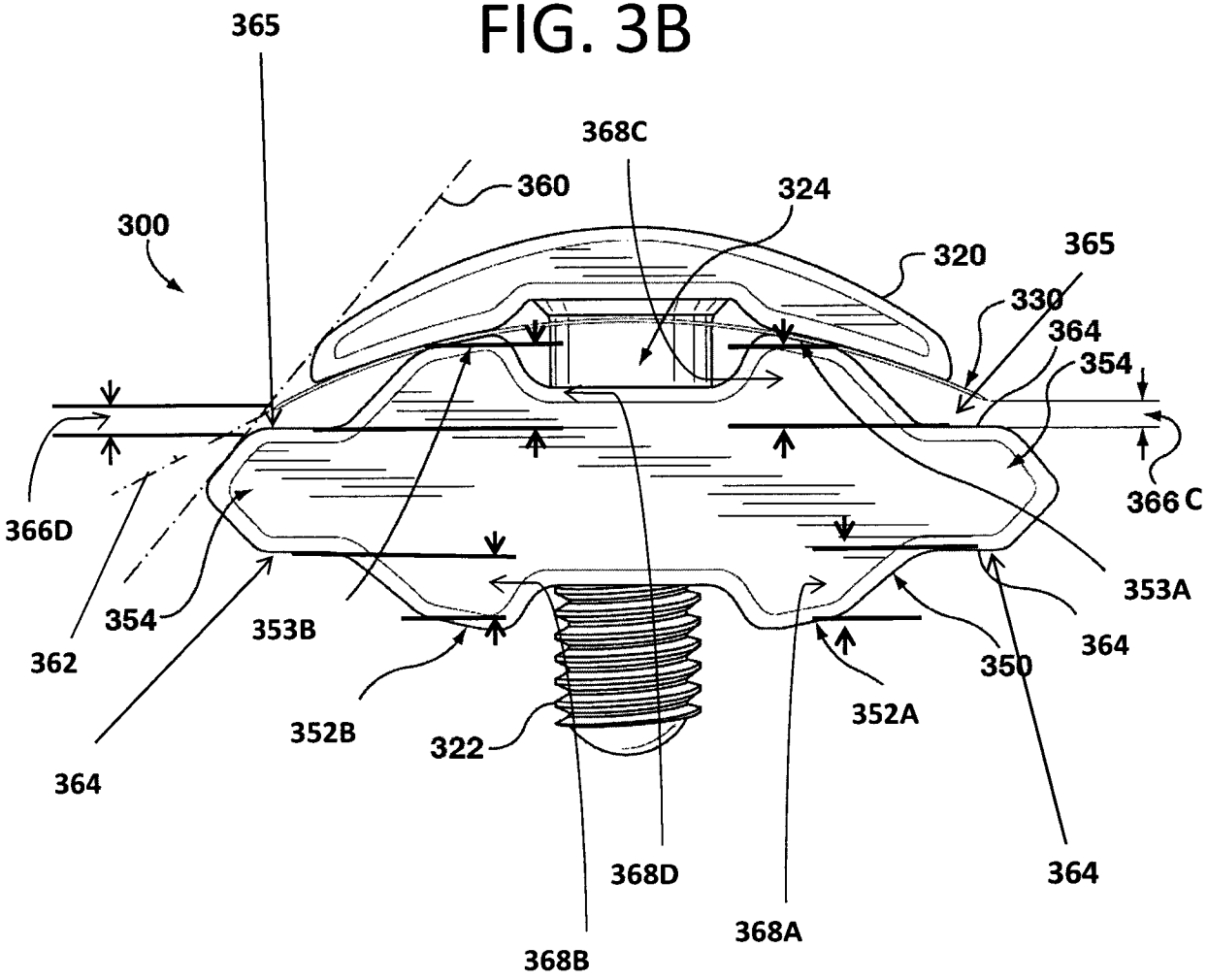
FIG. 3B is a side view of a cap and a double sided base plate embodiment of a safety razor securing a double-edged safety razor between the cap and the second side of the double sided base plate.
Figure 4:
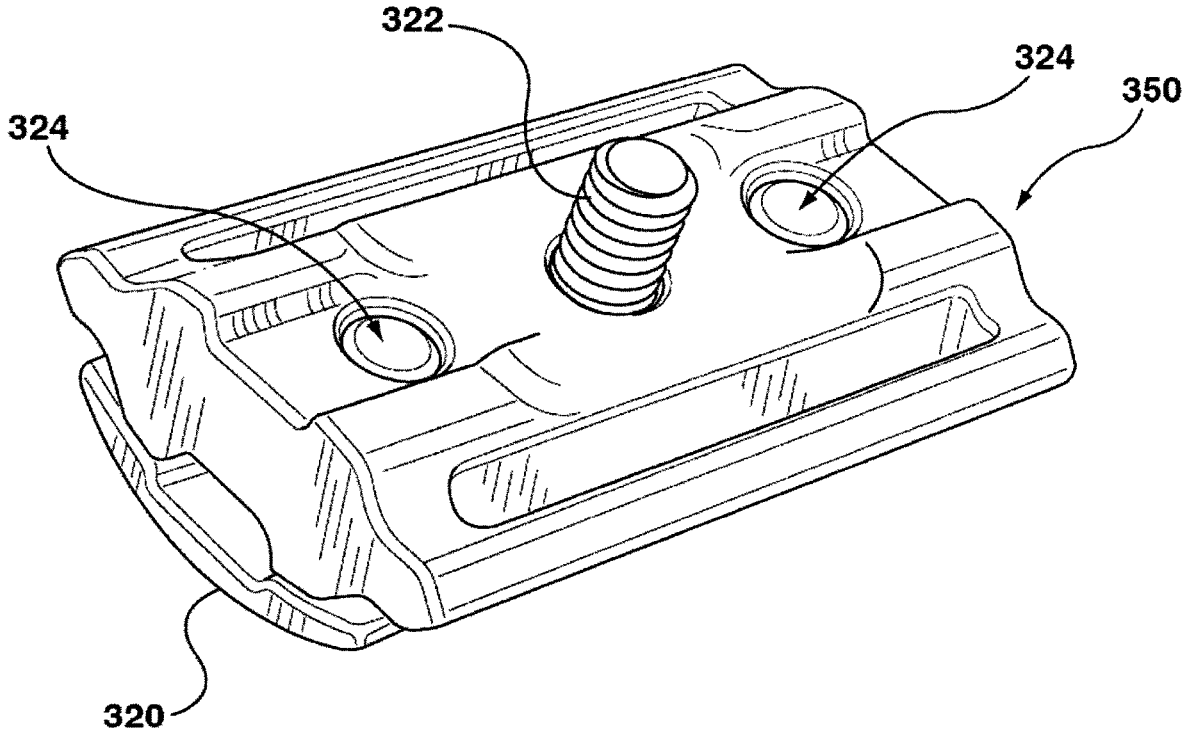
FIG. 4 is a bottom perspective view of the embodiment shown in FIG. 3A.

Referring now to FIGS. 3A, 3B and 4, shown are cap 320 and base plate 350 for safety razor assembly 300. Cap 320 and double sided base plate 350 may have any of the features described above with respect to cap 120 and double sided base plate 150. The handle 110 has been omitted from these figures, however, may be included. Cap 120 my have a central threaded stud 322 to threadingly engage a handle, such as handle 110 shown in FIGS. 1 and 2. Other embodiments may have a threaded stud at the end of the handle and the central stud 322 of cap 320 can be configured to threadingly engage the threaded stud of the handle. The double sided base plate 350 can define a central aperture 351, for example, for receiving the threaded stud therethrough.

Cap 320 may, in some embodiments, have at least one projection 324 that projects from the bottom surface of cap 320. Projection 324, which in some embodiments, for example, may be a bullet post, may be useful to aid in alignment of razor blade 330 which includes apertures to receive projection 324 and central threaded stud 322. Similarly, double sided base plate 350 defines central aperture 351 to allow central threaded stud to pass through to mate with a handle, such as handle 110, and double sided base plate 350 further defines alignment aperture 355 that correspond with one or more bullet posts 324 of cap 320.

The double sided base plate 350 comprises a first side having a first angled blade-engaging surface 352A opposite a second angled blade-engaging surface 352B (the first and second angled blade-engaging surfaces may be collectively referred to as 352), the first and second blade engaging surfaces 352 defining a respective first 366A and second 366B blade gap when a double edged safety razor blade 330 is secured between the cap 320 and the first side of the double sided base plate 350.

The double sided base plate 350 further comprises a second side having a third angled blade-engaging surface 353A opposite a fourth angled blade-engaging surface 353B (the first and second blade-engaging surfaces collectively referred to as 353), the third and fourth blade engaging surfaces 353 defining a respective third 366C and fourth blade gap 366D when a double edged safety razor blade 330 is secured between the cap 320 and the second side of the double sided base plate 350. First blade gap 366A, second blade gap 366B, third blade gap 366C and fourth blade gap 366D may all be collectively referred to as blade gaps 366.

When a handle is attached, or in some embodiments, screwed, onto the cap 320 and safety razor assembly 300, pressure is applied to razor blade 330 positioned between cap 320 and double sided base plate 350. This compression force causes razor blade 330 to conform to a surface area of blade-engaging surfaces 352A and 352B (or third and fourth blade engaging surfaces 353A and 353B when the base plate 350 is oriented such that the third and fourth blade engaging surfaces 353 are engaging the blade 330) of base plate 350 to cause razor blade 330 to flex. The bottom surface of cap 320 provides concave surfaces to allow razor blade 330 to bend against the surface area of the blade-engaging surfaces to provide a downward angle when razor blade 330 is secured between the cap 320 and the double sided base plate 350.

Blade-engaging surfaces 352, or blade engaging surfaces 353 when the base plate 350 is oriented such that the third and fourth blade engaging surfaces 353A and 353B are engaging the blade 330, each define a blade angle of razor blade 330, and thus in part, define the aggressiveness of the shave with the safety razor assembly 300 with respect to that specific blade engaging surface. The blade angle is defined relative to a line that would lie planar with the face when shaving that is illustrated by dotted line 360 and line 362 that is tangential to razor blade 330 near its end. The planar face line is formed between the edges of cap 320 and the outer edge of guard portion 354 of base plate 350 that make contact with the face when shaving.

Each of blade-engaging surfaces 352 and 353 further define a respective height of the respective blade-engaging surface relative to the corresponding surface 364 or 365 of guard portion 354. First and second blade engaging surfaces 352A, 352B respectively define first blade-engaging surface height 368A and second blade-engaging surface height 368B. Third and fourth blade engaging surfaces 353A, 353B respectively define third blade-engaging surface height 368C and fourth blade-engaging surface height 368D. the blade engaging surface heights may collectively be referred to as blade engaging surface heights 368.

The blade engaging surface heights 368 of the respective blade engaging surfaces 352 or 353 may influence the blade gaps 366 and blade angles of base plate 350 when the razor blade 330 is secured between the base plate 350 and the cap 320. Blade gap 366 is the gap between the blade 330 and the corresponding surface 364 or 365 of guard portion 354 to allow for light or heavy growth beards or to suit the skill or custom of the shaver. Blade gap 366 may also be a factor in defining the aggressiveness of the shave.

For example, increasing any one of the blade engaging surface heights 368 may lead to a corresponding increase in the respective blade gap 366 and blade angle, and therefore may increase the aggressiveness of the shave. Conversely, a decrease in any one of the blade engaging surface heights 368 may lead to a corresponding decrease in the respective blade gap 366 and blade angle, and therefore may decrease the aggressiveness of the shave. In addition to the blade engaging surface heights 368, such factors as the stiffness of the blade 330, the length and/or tapering of guards 354, guard 354 style (e.g. open comb v.s. guard bar) and the curvature of the cap 320 may influence the aggressiveness of the shave.

In some embodiments of base plate 350, the first blade gap 366A and the second blade gap 366B may be the same or different. In some embodiments of base plate 350, for example, the third blade gap 366C and the fourth blade gap 366D may be the same or different. In some embodiments, the first blade gap 366A, the second blade gap 366B, the third blade gap 366C and the fourth blade gap 366D are different. In some embodiments of base plate 350, the first blade-engaging surface height 368A and the second blade-engaging surface height 368B may be the same or different. In some embodiments, the third blade-engaging surface height 368C and the fourth blade-engaging surface height 368D may be the same or different.

The double sided base plate 350 therefore enables up to four different blade gaps 366, blade angles, or blade engaging surface heights 368 per double sided base plate 350, and therefore enables a greater variety of aggressiveness for a user using a single base plate 350, without the need for multiple razors. Further, by enabling a user to select one of up to four different blade gaps 366, blade angles, or blade engaging surface heights 368 to shave with, the user is provided with greater customizability to match his or her beard or hair growth, use preferences, skills and prior shaving experience to the aggressiveness of the shave. Additionally, a double sided base plate having up to four different blade gaps 366, blade angles, or blade engaging surface heights 368 may reduce manufacturing costs, and increase user convenience, when compared to utilizing multiple base plates necessary to provide. Having a safety razor with double sided base plates 350 that may be user-replaceable allows a user to obtain greater customizability and choice with respect to shaving aggressiveness at a lower cost to the user. The surface of each side of base plate 350 can include markings that indicate its level of aggressiveness, for example, by using a numbered scale to indicate a level of aggressiveness, as shown, for example, in FIG. 6. Base plate 350 is also configured to allow a shaver to use one side of the safety razor until, for example, it is full of shaving cream, then flip the safety razor over to shave with the other side and then rinse out the safety razor for another pass.

In some embodiments, there is provided a modular safety razor shaving kit, the kit comprising: a handle a cap; an attachment mechanism to engage the handle and the cap; and a plurality of double sided base plates, each of the plurality of double sided base plates defining a central aperture for enabling the engagement between the handle and the cap, each of the plurality of double sided base plates comprising: a first side having a first angled blade-engaging surface opposite a second angled blade-engaging surface, the first and second blade engaging surfaces defining a respective first and second blade gap when a double edged safety razor blade is secured between the cap and the first side of the double sided base plate, the first and second blade gaps defining a first blade gap set; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate, the third and fourth blade gaps defining a second blade gap set.

Figure 5:
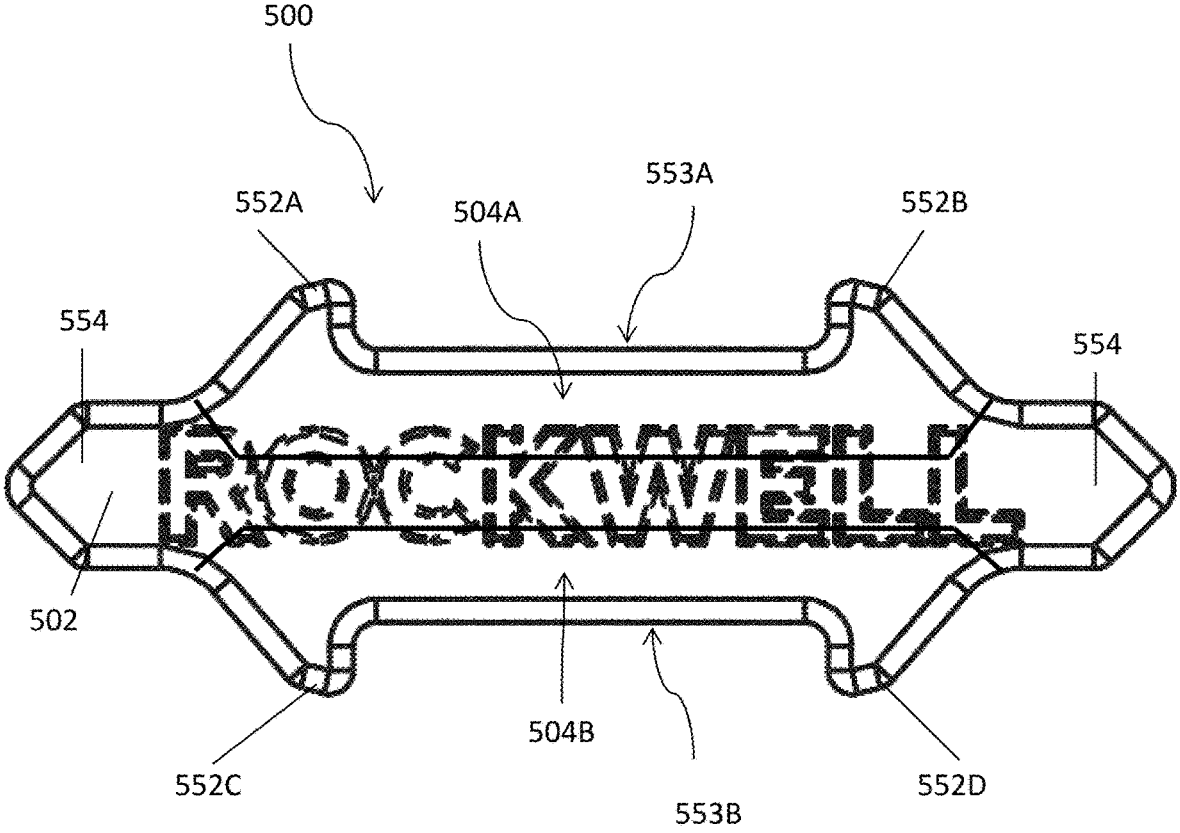
FIG. 5 is a side view of an embodiment of a modular double sided base plate.

Referring now to FIG. 5, there is shown is a side view of an embodiment of a base plate 500 wherein the double sided base plate 500 comprises a base portion 502 having at least one guard portion 554 and modular aggressiveness defining portions 504A and 504B (modular aggressiveness defining portions may be referred to collectively using 504) that are replaceable on each of the respective first and the second sides of the double sided base plate 500 to adjust aggressiveness of the safety razor. Base portion 502 has a guard portion 554 to provides guard function and may also include lather slots. Modular aggressiveness portion 504A and 504B can be swapped with other portions that provide differing levels of aggressiveness to allow adjustment of the aggressiveness of the safety razor. Portions 504 and base portion 502 have complementary mating surfaces and are held together, for example, by compression, adhesives or other attachment means between the cap and the handle. A recess 553A may be defined between the blade engaging surfaces 552A and 552B. A recess 553B may also be defined between blade engaging surfaces 552C and 552D. Each aggressiveness defining portion 504 can provide a different blade-engaging surface (each of 552A through 552D collectively referred to as 552) that defines the blade angle of a razor blade. Each differing aggressiveness defining portion 504 can also provide a differing blade gap by having blade-engaging surface 552 a different displacement above planar portion of base portion 502, which may be a function of a respective height of the blade-engaging surface 552 relative to the corresponding surface 364 or 365 of guard portion 354.

Figure 6:
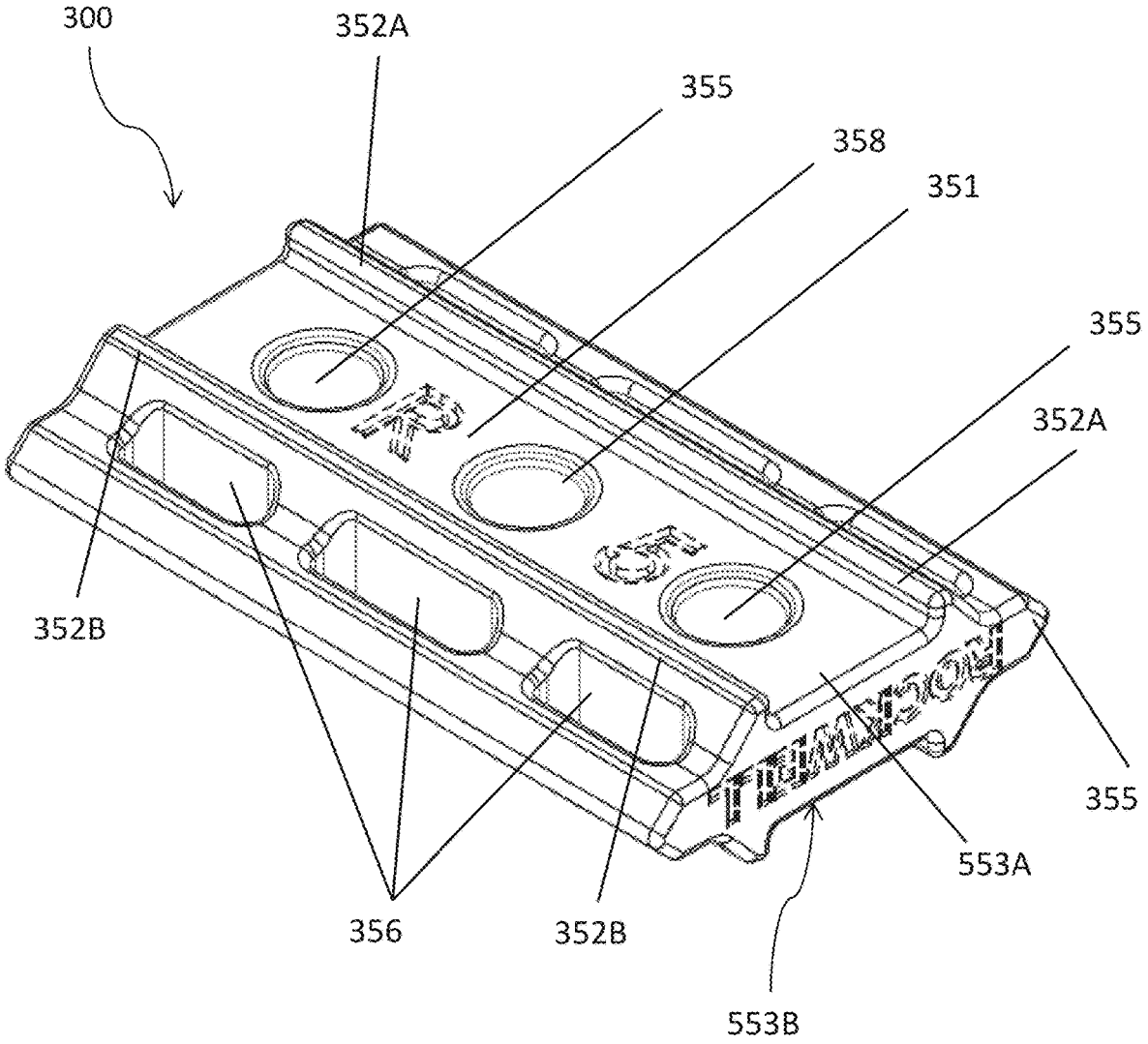
FIG. 6 is a top perspective view of an embodiment of a double sided base plate.

Referring now to FIG. 6, shown is a top perspective view of a double sided base plate. Guard portions 354 define one or more lather slots 356 to allow lather to pass through to avoid blocking the exposure of the razor blade when shaving. Lather slots 356 preferably correspond with the edge of razor blade 330 to allow lather and cut stubble to move through the blade gap and into lather slots 356.

FIG. 6 also illustrates mating surface 358 of double sided base plate 350. Preferably, mating surface 358 is planar and abuts the planar surface at the top of handle 110. Double sided base plate 350 has an opposing mating surface on the opposite side to allow the double-sided base plate 350 to be flipped.

In some embodiments, recess 553A and/or 553B may each be defined by a mating surface 358 between blade engaging surfaces 552A and 552B, and/or between blade engaging surfaces 552C and 552D, Mating surface 358 can interrupt angled blade-engaging surfaces 352. The curvature applied to razor blade 330 by base plate 350 and cap 320 provide rigidity and stability to razor blade 330 such that, in some embodiments, angled blade-engaging surfaces 352 do not need run the full length of double sided base plate 350. This interruption and larger mating surface 358 may allow handles with a larger top surface to mate with base plate 350. Mating surface 358 is disposed below angled blade-engaging surfaces as to not interfere with razor blade 330 when base plate 350 is flipped (i.e. when the opposing mating surface is abutting handle 110).

It will be appreciated by those skilled in the art that other variations of the embodiments described herein may also be practiced without departing from the scope of the invention. Other modifications are therefore possible.

Although the disclosure has been described and illustrated in exemplary forms with a certain degree of particularity, it is noted that the description and illustrations have been made by way of example only. Numerous changes in the details of construction and combination and arrangement of parts and steps may be made. Accordingly, such changes are intended to be included in the invention, the scope of which is defined by the claims.

Except to the extent explicitly stated or inherent within the devices and apparatuses described, including any optional components thereof, no required order, sequence, or combination is intended or implied. As will be will be understood by those skilled in the relevant arts, with respect to any devices or apparatuses, etc., described herein, a wide range of variations is possible, and even advantageous, in various circumstances, without departing from the scope of the invention, which is to be limited only by the claims.

The invention claimed is:

1. A double sided base plate for use with a safety razor, the double sided base plate comprising:

a first side having a first angled blade-engaging surface opposite a second angled blade-engaging surface, the first and second blade engaging surfaces defining a respective first and second blade gap when a double edged safety razor blade is secured between a cap and the first side of the double sided base plate; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate, wherein the first and second angled blade-engaging surfaces define a recess between said first and second angled blade-engaging surfaces, the recess defined by a first mating surface between the first and second angled blade-engaging surfaces, the first mating surface spanning substantially an entire length of the double sided base plate, and wherein the first and second angled blade-engaging surfaces are substantially parallel to the edge of the double edged safety razor blade when the double edged safety razor blade is secured between the cap and the first side of the double sided base plate, wherein when the double edged safety razor blade is secured between the cap and the first side of the double sided base plate, a compression force causes the double edge safety razor blade to conform to the angled blade engaging surfaces causing the double edge safety razor blade to flex, and wherein a bottom surface of the cap provides a concave surface which bends the double edge safety razor blade to provide a downward angle, wherein the each of the first and second angled blade-engaging surface defines an included surface area for providing the downward angle when the double edged safety razor is secured between the cap and the first side of the double sided base plate.

2. The double sided base plate of claim 1, wherein the first side defines the first mater surface and the second side defines a second mating surface, wherein each of the first and second mating surfaces abuts a top surface of the handle, the first and second mating surfaces disposed below the respective angled blade-engaging surfaces of the first and second sides of the double sided base plate.

3. The double sided base plate of claim 2, wherein the first angled blade-engaging surface and the second angled blade-engaging surface are each interrupted by the first mating surface.

4. The double sided base plate of claim 2, wherein the third angled blade-engaging surface and the fourth angled blade-engaging surface are each interrupted by the second mating surface.

5. The double sided base plate of claim 1, wherein the double sided base plate has at least one guard portion.

6. The double sided base plate of claim 5, wherein each of the at least one guard portion defines a lather slot that corresponds with an edge of the safety razor blade.

7. The double sided base plate of claim 1, wherein the double sided base plate comprises a base portion having at least one guard portion and a modular aggressiveness defining portion that is replaceable on each of the first and the second sides to adjust aggressiveness of the safety razor.

8. The double sided base plate of claim 1, wherein the first blade gap and the second blade gap are the same.

9. The double sided base plate of claim 1, wherein the third blade gap and fourth blade gap are the same.

10. The double sided base plate of claim 1, wherein the first angled blade-engaging surface has a first blade engaging surface height different than a second blade engaging height of the second angled blade-engaging surface.

11. The double sided base plate of claim 1, wherein when a double edged safety razor blade is secured between the cap and the first side of double sided base plate, the cap extends through a plane defined by an edge of each of the first and second blade-engaging surfaces of the double sided base plate to flex the double edged safety razor blade, and wherein the first and second angled blade-engaging surfaces are at an angle with respect to the plane.

12. A safety razor comprising:

a handle;

a cap;

an attachment mechanism to engage the handle and the cap; and a double sided base plate defining a central aperture for enabling the engagement between the handle and the cap, the double sided base plate comprising:

a first side having a first angled blade-engaging surface opposite a second angled blade-engaging surface, the first and second blade engaging surfaces defining a respective first and second blade gap when a double edged safety razor blade is secured between the cap and the first side of the double sided base plate; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate, wherein the first and second angled blade-engaging surfaces define a recess between said first and second angled blade-engaging surfaces, the recess defined by a first mating surface between the first and second angled blade-engaging surfaces, the first mating surface spanning substantially an entire length of the double sided base plate, and wherein the first and second angled blade-engaging surfaces are substantially parallel to the edge of the double edged safety razor blade when the double edged safety razor blade is secured between the cap and the first side of the double sided base plate, wherein when the double edged safety razor blade is secured between the cap and the first side of the double sided base plate, a compression force causes the double edge safety razor blade to conform to the angled blade engaging surfaces causing the double edge safety razor blade to flex, and wherein a bottom surface of the cap provides a concave surface which bends the double edge safety razor blade to provide a downward angle, wherein the each of the first and second angled blade-engaging surface defines an inclined surface area for providing the downward angle when the double edged safety razor is secured between the cap and the first side of the double sided base plate.

13. The safety razor of claim 12, wherein the first side defines the first mating surface and the second side defines a second mating surface, wherein each of the first mating surfaces that abuts a top surface of the handle, the first and second mating surfaces disposed below the respective angled blade-engaging surfaces of the first and second sides of the double sided base plate.

14. The safety razor of claim 13, wherein the first angled blade-engaging surface and the second angled blade-engaging surface are each interrupted by the first mating surface.

15. The safety razor of claim 13, wherein the third angled blade-engaging surface and the fourth angled blade-engaging surface are each interrupted by the second mating surface.

16. The safety razor of claim 12, wherein the cap has at least one projection for aligning the double edged safety razor blade and the double sided base plate has at least one corresponding alignment aperture for receiving the at least one projection.

17. The safety razor of claim 12, wherein the double sided base plate has at least one guard portion.

18. The safety razor of claim 17, wherein each of the at least one guard portion defines a lather slot that correspond with an edge of the safety razor blade.

19. The safety razor of claim 12, wherein the double sided base plate comprises a base portion having at least one guard portion and a modular aggressiveness defining portion that is replaceable on each of the first and the second sides to adjust aggressiveness of the safety razor.

20. The safety razor of claim 12, wherein the attachment mechanism comprises a central threaded stud disposed on the cap to threadingly engage the handle.

21. The safety razor of claim 12, wherein the attachment mechanism comprises a central threaded stud disposed on the handle to threadingly engage the cap.

22. The safety razor of claim 12, wherein the first blade gap and the second blade gap are the same.

23. The safety razor of claim 12, wherein the third blade gap and the fourth blade gap are the same.

24. The safety razor of claim 12, wherein the first angled blade-engaging surface has a first blade engaging surface height different than a second blade engaging height of the second angled blade-engaging surface.

25. The safety razor of claim 12, wherein when a double edged safety razor blade is secured between the cap and the first side of double sided base plate, the cap extends through a plane defined by an edge of each of the first and second blade-engaging surfaces of the double sided base plate to flex the double edged safety razor blade, and wherein the first and second angled blade-engaging surfaces are at an angle with respect to the plane.

26. A modular safety razor shaving kit, the kit comprising:

a handle a cap;

an attachment mechanism to engage the handle and the cap; and a plurality of double sided base plates, each of the plurality of double sided base plates defining a central aperture for enabling the engagement between the handle and the cap, each of the plurality of double sided base plates comprising:

a first side having a first angled blade-engaging surface opposite a second angled blade-engaging surface, the first and second blade engaging surfaces defining a respective first and second blade gap when a double edged safety razor blade is secured between the cap and the first side of the double sided base plate, the first and second blade gaps defining a first blade gap set; and a second side having a third angled blade-engaging surface opposite a fourth angled blade-engaging surface, the third and fourth blade engaging surfaces defining a respective third and fourth blade gap when a double edged safety razor blade is secured between the cap and the second side of the double sided base plate, the third and fourth blade gaps defining a second blade gap set, wherein the first and second angled blade-engaging surfaces define a recess between said first and second angled blade-engaging surfaces, the recess defined by a mating surface between the first and second angled blade-engaging surfaces, the mating surface spanning substantially an entire length of the double sided base plate, and wherein the first and second angled blade-engaging surfaces are substantially parallel to the edge of the double edged safety razor blade when the double edged safety razor blade is secured between the cap and the first side of the double sided base plate, wherein when the double edged safety razor blade is secured between the cap and the first side of the double sided base plate, a compression force causes the double edge safety razor blade to conform to the angled blade engaging surfaces causing the double edge safety razor blade to flex, and wherein a bottom surface of the cap provides a concave surface which bends the double edge safety razor blade to provide a downward angle, wherein the each of the first and second angled blade-engaging surface defines an inclined surface area for providing the downward angle when the double edged safety razor is secured between the cap and the first side of the double sided base plate.

27. The modular safety razor shaving kit of claim 26, wherein at least one of the first blade gap set and the second blade gap set are different for each of the plurality of double sided base plates.

28. The modular safety razor shaving kit of claim 26, wherein the first angled blade-engaging surface has a first blade engaging surface height different than a second blade engaging height of the second angled blade-engaging surface.

29. The modular safety razor shaving kit of claim 26, wherein when a double edged safety razor blade is secured between the cap and the first side of double sided base plate, the cap extends through a plane defined by an edge of each of the first and second blade-engaging surfaces of the double sided base plate to flex the double edged safety razor blade, wherein the first and second angled blade-engaging surfaces are at an angle with respect to the plane.

* * * * *